US006216408B1

(12) United States Patent
Davidson

(10) Patent No.: US 6,216,408 B1
(45) Date of Patent: Apr. 17, 2001

(54) COPING ASSEMBLY

(75) Inventor: Don Davidson, Tyler, TX (US)

(73) Assignee: Petersen Aluminum Corporation, Elk Grove Village, IL (US)

( * ) Notice: Subject to any disclaimer, the term of this patent is extended or adjusted under 35 U.S.C. 154(b) by 0 days.

(21) Appl. No.: 09/590,445

(22) Filed: Jun. 9, 2000

(51) Int. Cl.[7] ..... E04F 19/02
(52) U.S. Cl. ..... 52/300; 52/60
(58) Field of Search ..... 52/300, 58, 59, 52/60, 97, 96

(56) References Cited

U.S. PATENT DOCUMENTS

Re. 28,870 6/1976 Attaway et al. .
4,083,158 4/1978 Wolma .
4,858,406 8/1989 Lane et al. .
4,964,248 * 10/1990 Braine et al. ..... 52/60
5,289,662 * 3/1994 Castle ..... 52/58

* cited by examiner

*Primary Examiner*—Michael Safavi
(74) *Attorney, Agent, or Firm*—Mason, Kolehmainen, Rathburn & Wyss; Philip M. Kolehmainen

(57) ABSTRACT

The top of a wall is covered by a coping assembly including an inverted U-shaped cap supported by outside and inside formed sheet metal cleats fastened to the wall. The outside cleat includes a horizontal top panel nailed to the top of the wall and a vertical outside panel nailed to the front surface of the wall. A brace including an upwardly extending portion of the vertical outside panel and an upwardly inclined strut supports the forward part of the cap. An inclined spring portion of the outside cleat supports the center of the cap. An inside cleat has a horizontal top panel nailed to the wall and a vertical inside panel portion. The cap has depending outside and inside wall sections with lower extremities that interlock with lower edges of the vertical outside and inside panels.

4 Claims, 2 Drawing Sheets

COPING ASSEMBLY

FIELD OF THE INVENTION

The present invention relates to an improved coping assembly for covering the top of a wall such as a parapet.

DESCRIPTION OF THE PRIOR ART

Coping assemblies are used to protect the top of a wall from water and weather and to provide an attractive appearance. A coping assembly should be easy to install with a minimum of time and effort, should be strong and durable, should be able to fit walls of various thicknesses and should be inexpensive to fabricate. Despite a long standing need, known coping assemblies have not satisfied all of the these requirements.

U.S. Pat. No. Re 28,870 discloses a coping structure with a cap or channel member that is not continuously supported along its length and therefor lacks strength unless an expensive, strong material is used for the cap. In addition, all of the components of the coping structure are sized for one wall thickness. None of the components of a structure of this type can be used with a range of wall thicknesses.

U.S. Pat. No. 4,083,158 discloses a coping mounting plate that attempts to address the problem of adaptability to a range of wall thicknesses. It includes two clamps that have interlocking keys and keyways so that the width of the clamps when assembled is adjustable to fit different wall thicknesses. The use of keys permits width adjustments only in discrete steps and continuously variable width adjustment is not possible. The clamps with keys and keyways are complex and expensive extruded parts.

U.S. Pat. No. 4,858,406 discloses a coping structure that has a fixed width that is not suited for a range of wall thicknesses. Moreover, in order to provide sufficient strength, the structure includes a rigid anchor bar that is a complex, expensive extruded part.

SUMMARY OF THE INVENTION

A principal object of the present invention is to provide an improved coping assembly for covering the top of a wall. Other objects are to provide a coping assembly that is continuously variable in width to accommodate a range of wall thicknesses; to provide a coping assembly that avoids the use of complex and expensive extruded parts; to provide a coping assembly that provides ample strength with the use of simple formed sheet metal supporting cleats; and to provide a coping assembly that overcomes problems encountered with coping assemblies used in the past.

In brief, in accordance with the invention there is provided a coping assembly for covering the top of a wall having front, rear and top surfaces with fastener receiving areas on the front and top surfaces. The coping assembly includes an elongated sheet metal outside cleat having a uniform cross section throughout its length. The outside cleat includes a vertical outside panel with a lower edge, the vertical outside panel overlying the fastener receiving area of the front surface of the wall. The outside cleat also includes a horizontal top panel overlying the fastener receiving area of the top surface of the wall. A spring portion is inclined upwardly at the rear boundary of the horizontal top panel. The vertical outside panel extends upwardly beyond the plane of the horizontal top panel, and a strut portion extends upwardly and forwardly from the forward boundary of the horizontal top panel to the top of the vertical outside panel to define a triangle shaped brace. An elongated sheet metal inside cleat has a uniform cross section throughout its length and has a vertical inside panel with a lower edge. An elongated cap has a uniform generally U-shaped cross section throughout its length, the cap having a top section and depending outside and inside wall sections both having lower extremities, the outside and inside wall sections respectively overlying the vertical outside panel and the vertical inside panel. The lower extremities of the outside and inside wall sections including structure interlocking with the lower edges of the vertical outside and inside panels. The spring portion supports a central region of the top section and the brace supports a forward region of the top section.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
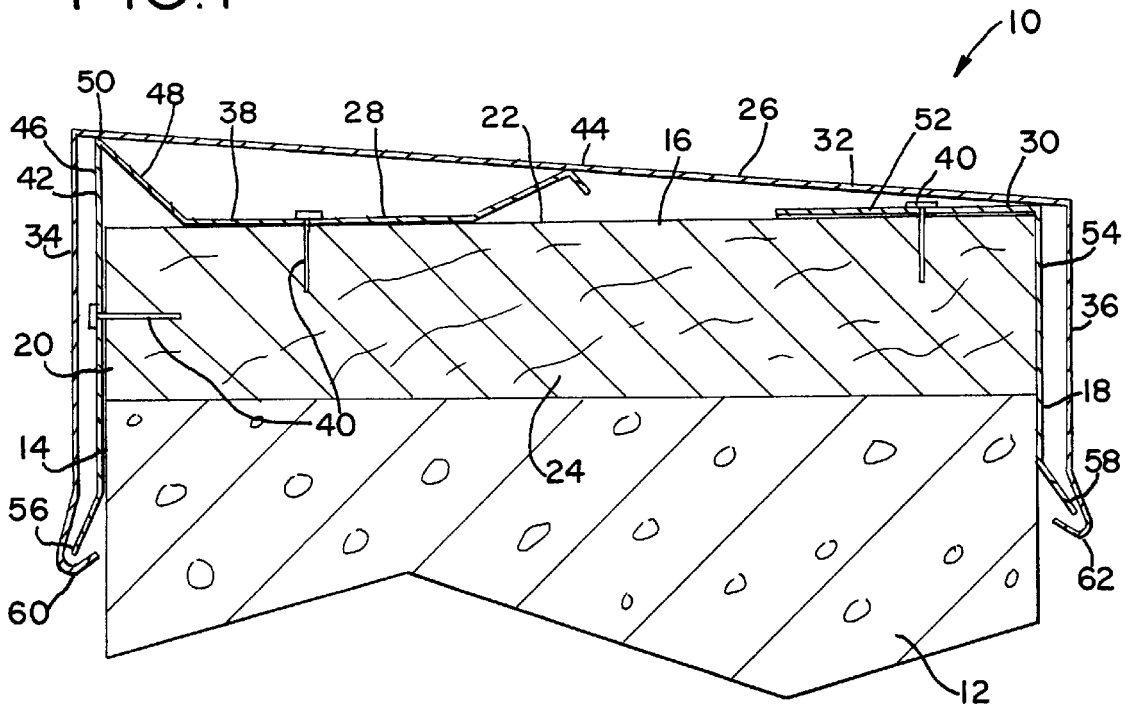
FIG. 1 is a cross sectional view of a wall covered by a coping assembly constructed in accordance with the present invention.

Having reference now to the drawings, FIG. 1 illustrates a cross section of a coping assembly generally designated as 10 and constructed in accordance with the principles of the present invention. The coping assembly 10 is installed to cover the top of a wall 12 having a front (or outside) surface 14, a top surface 16 and a rear (or inside) surface 18. For attachment of the coping assembly 10 to the wall 12, the wall should be able to accept fasteners at a front fastener receiving area 20 and a top fastener receiving area 22. Preferably an elongated solid wood nailer 24 is secured at the top of the wall 12.

The coping assembly 10 includes an elongated cap 26 held in place on the wall 12 by an elongated outside cleat 28 and by an elongated inside cleat 30. The outside cleat 28 is located at the front 14 and the top 16 of the wall 12. The inside cleat 30 is located at the rear 18 and top 16 of the wall 12.

Figure 3:
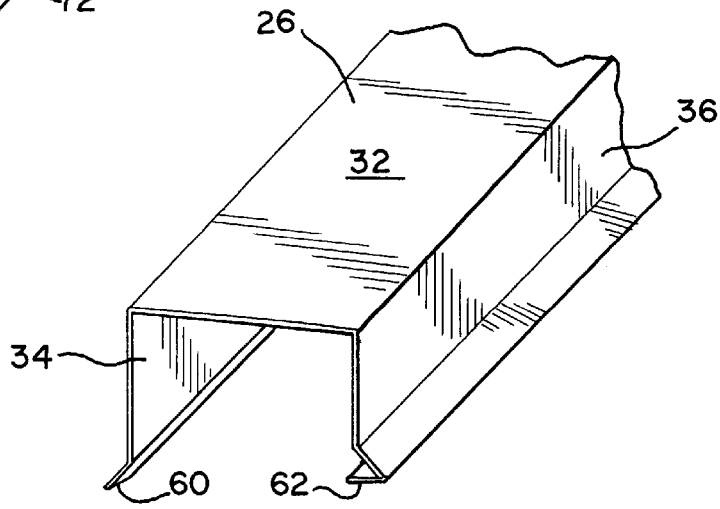
FIG. 3 is a fragmentary isometric view of the cap of the coping assembly.

Cap 26 seen in FIGS. 1 and 3 is an elongated metal body having a uniform cross section throughout its length. Preferably the cap 26 is made by forming a length of sheet metal having a uniform thickness, such as 22 gauge or 24 gauge galvanized steel material or aluminum sheet having a thickness in the range of from 0.050 inch to 0.125 inch. Only the cap 26 is visible when the coping assembly 10 is in place on the wall 12 and the outer surface of the cap 26 may be provided with an attractive and durable coating. The cap 26 in cross section has an inverted U-shape with a top section 32 spanning the width of the wall 12 and depending outside and inside wall sections 34 and 36. To assure runoff of water from the cap 26, the top section 32 is slightly inclined from horizontal by an angle of a few degrees.

Figure 4:
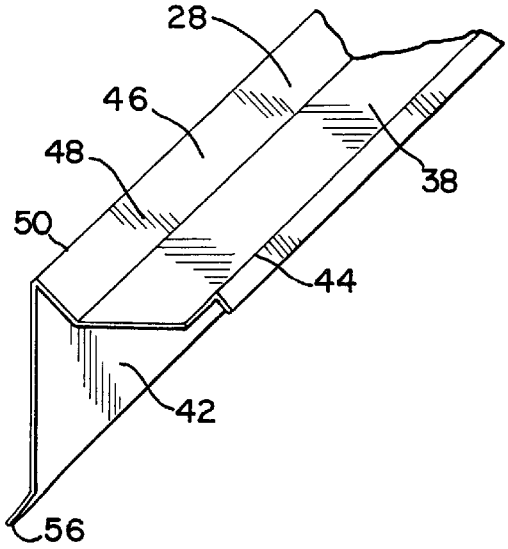
FIG. 4 is a fragmentary isometric view of the outside cleat of the coping assembly.

The outside cleat 28 (FIGS. 1 and 4) is formed of sheet metal such as 22 gauge or 24 gauge galvanized steel sheet and has a uniform cross section throughout its length. It includes a horizontal top panel 38 overlying and attached to the top fastener receiving area 22 of wall 12 by longitudinally spaced nails 40. A vertical outside panel 42 of the outside cleat 28 overlies and is attached to the front fastener receiving area 20 by additional longitudinally spaced nails 40. A spring portion 44 is inclined upwardly and rearwardly from the rear boundary of the horizontal top panel to support the central region of the top section 32 of the cap 26.

Support for the forward portion of the cap 26 is provided by a sturdy brace structure 46 incorporated into the outside cleat 28. The vertical outside panel 42 extends upwardly beyond the top surface 16 of the wall 12. A strut portion 48 extends upward and forward from the forward boundary of the horizontal top panel 38 and meets the vertical outside panel 42 at a fold or crease 50. The brace structure 46 is firmly anchored to the wall 12 by the nails 40 along both margins of the brace structure and the fold 50 at the upward tip of the brace margins structure firmly supports the forward portion of the top section 32 of the cap 26.

The inside cleat 30 (FIGS. 1 and 5) is formed of sheet metal such as 22 gauge or 24 gauge galvanized steel sheet and has a uniform cross section throughout its length. It includes a horizontal top panel 52 overlying and attached to the top fastener receiving area 22 of wall 12 by additional longitudinally spaced nails 40. A vertical inside panel 54 of the inside cleat 30 overlies the rear surface 18 of the wall 12. The vertical inside panel is not nailed to the wall 12 and may be spaced from the rear surface 18 of the wall.

Figure 5:
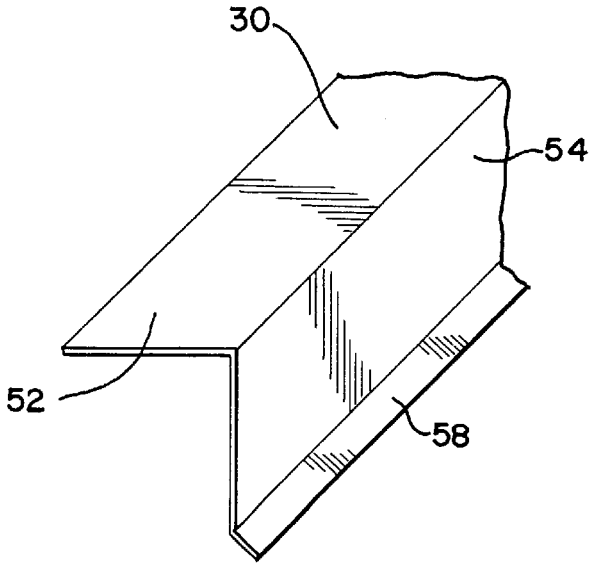
FIG. 5 is a fragmentary isometric view of the inside cleat of the coping assembly.

The outside cleat 28 includes a forwardly inclined outside lower edge 56 at the bottom of the vertical outside panel 42. The inside cleat 30 includes a rearwardly inclined inside lower edge 58 at the bottom of the vertical inside panel 54. The outside wall section 34 of the cap 26 includes an outside lower extremity 60 that interlocks with the outside lower edge 56. The extremity 60 is a channel that receives the lower edge 56. The inside wall section 36 of the cap 26 includes an inside lower extremity 62 that interlocks with the inside lower edge 58. Before installation as seen in FIG. 5 the inside lower extremity 62 is in a horizontal plane that permits the cap 26 to be installed over the outside and inside cleats 28 and 30. When in place, the inside lower extremity is crimped upwardly to capture the inside lower edge 58 in the resulting channel shape seen in FIG. 1. The crimps can be spaced apart along the length of the cap 26.

Figure 2:
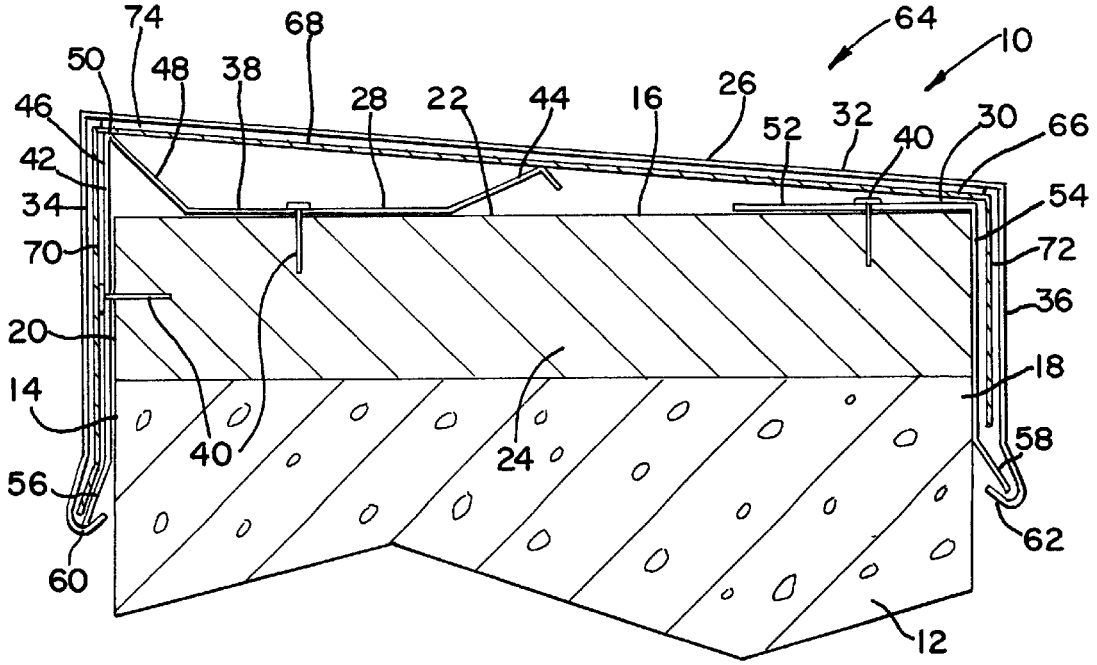
FIG. 2 is a cross sectional view like FIG. 1 showing a splice joint of the coping assembly.
Figure 6:
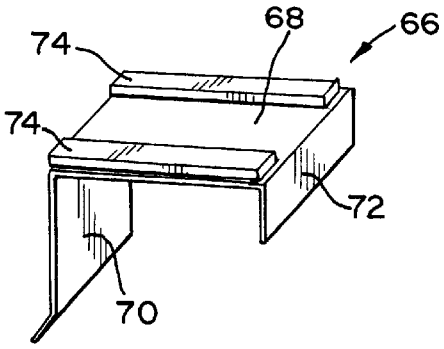
FIG. 6 is an isometric view of the splice plate of the coping assembly.

Multiple cleats 28 and 30 and caps 26 can be used along the length of the wall 12. FIG. 2 illustrates a splice joint 64 including a splice plate 66 spanning a gap between ends of aligned cleats 28 and 30 and aligned caps 26. The splice plate 66 (FIGS. 2 and 6) is preferably a short length of formed galvanized steel sheet metal which may be similar to the material of the cleats 28 and 30. It includes a top wall 68 and depending forward and rear walls 70 and 72. When the coping assembly 10 is installed, a small expansion gap is left between the abutting ends of adjacent cleats 28 and between the abutting ends of adjacent cleats 30 and the splice plate is placed over this gap. Then the adjacent caps 26 are placed over the cleats and over the splice plate 66 with a similar small expansion gap between the abutting ends of the caps 26. Strips 74 of resistent sealing material such as neoprene extend across the width of the top wall 68 to form a gutter under the gap between caps 26 so that water entering the gap flows transversely across the splice plate 66.

The coping assembly 10 of the present invention is adaptable to a range of wall thicknesses. The width of the cap 26 and the splice plate 66 is specified for the wall thickness of a particular application but a cost saving is realized because the outside and inside cleats 28 and 30 are standard parts that can be used for many wall thicknesses. For relatively thick walls where additional support is needed across the width of the top section 32 of the cap 26, an additional spring portion like the spring portion 44 can be added to the inside cleat 30. The spring portion 44 at the rear of the outside cleat 28 provides support for the central portion of the cap 26. The cap 26 is supported throughout its length. Additional cost saving is achieved because the entire cleat system including the outside and inside cleats 28 and 20 is fabricated from inexpensive sheet metal material. The brace structure 46 anchored at both sides by nails 40 provides ample strength without the need for stronger but more expensive materials such as metal extrusions.

While the present invention has been described with reference to the details of the embodiment of the invention shown in the drawing, these details are not intended to limit the scope of the invention as claimed in the appended claims.

What is claimed is:

1. A coping assembly for covering the top of a wall having front, rear and top surfaces with fastener receiving areas on the front and top surfaces, said coping assembly comprising:

an elongated sheet metal outside cleat having a uniform cross section throughout its length;

said outside cleat including a vertical outside panel with a lower edge, said vertical outside panel overlying the fastener receiving area of the front surface of the wall;

said outside cleat including a horizontal top panel overlying the fastener receiving area of the top surface of the wall;

said outside cleat including a spring portion inclined upwardly at the rear boundary of said horizontal top panel;

said vertical outside panel extending upwardly beyond the plane of said horizontal top panel, and said outside cleat including a strut portion extending upwardly and forwardly from the forward boundary of said horizontal top panel to the top of said vertical outside panel to define a triangle shaped brace;

an elongated sheet metal inside cleat having a uniform cross section throughout its length and having a vertical inside panel with a lower edge;

an elongated cap having a uniform generally U-shaped cross section throughout its length, said cap having a top section and depending outside and inside wall sections both having lower extremities, said outside and inside wall sections respectively overlying said vertical outside panel and said vertical inside panel;

said lower extremities of said outside and inside wall sections including structure interlocking with said lower edges of said vertical outside and inside panels; and said spring portion supporting a central region of said top section and said brace supporting a forward region of said top section.

2. The coping assembly of claim 1, said lower extremities of said outside and inside wall sections having hook shapes capturing said lower edges of said vertical outside and inside panels.

3. The coping assembly of claim 1, said outside and inside cleats being spaced apart.

4. The coping assembly of claim 1, said inside cleat having a horizontal top panel overlying the fastener receiving area of the top surface of the wall.

* * * * *